United States Patent [19]

Yao

[11] Patent Number: 4,934,413

[45] Date of Patent: Jun. 19, 1990

[54] WARP ARRANGEMENT AND CARRIER SYSTEM FOR AN AUTOMATIC LOOM

[75] Inventor: Masami Yao, Fuchu, Japan

[73] Assignee: Nissan Motor Co., Ltd., Yokohama, Japan

[21] Appl. No.: 340,601

[22] Filed: Apr. 19, 1989

[30] Foreign Application Priority Data

Jul. 13, 1988 [JP] Japan ..... 63-174646

[51] Int. Cl.[5] ..... D03D 49/04

[52] U.S. Cl. ..... 139/1 R; 139/109; 139/353; 242/58.6; 414/911

[58] Field of Search ..... 28/208; 414/911; 242/58.6; 139/1 R, 109, 353

[56] References Cited

U.S. PATENT DOCUMENTS 4,373,854 2/1983 Schultheis ..... 414/911 X
4,564,050 1/1986 Hirano ..... 139/109 X

FOREIGN PATENT DOCUMENTS 62-141160 6/1987 Japan .
62-184149 8/1987 Japan .
62-184151 8/1987 Japan .
62-206066 9/1987 Japan .

*Primary Examiner*—Andrew M. Falik
*Attorney, Agent, or Firm*—Foley & Lardner, Schwartz, Jeffery, Schwaab, Mack, Blumenthal & Evans

[57] ABSTRACT

In a looming system or method, warp yarns are mounted on a loom by the following four steps. At a first step, warp yarns of a full warp beam are drawn through a warp holding unit including a warp dropper unit, a heald unit and a reed. Then, at a second step, the full warp beam is mounted on the loom. At a third step, a warp tension is sensed between the warp beam and the warp holding unit. At a fourth step, the warp holding unit is moved toward the loom and mounted in the loom while rotating the warp beam so as to reduce a deviation of the sensed warp tension from a predetermined standard.

14 Claims, 22 Drawing Sheets

WARP ARRANGEMENT AND CARRIER SYSTEM FOR AN AUTOMATIC LOOM

BACKGROUND OF THE INVENTION

The present invention relates to looming systems and methods for mounting warp yarns on looms.

Japanese Patent Provisional Publications Nos. 62-184151, 62-184149, 62-141160 and 62-206066 show conventional looming methods. Each of these looming methods includes a preparatory step of preparing a warp arrangement, and a step of mounting the warp arrangement on a loom. The warp arrangement is an arrangement of a full warp beam, and weaving components such as a warp dropper unit, a heald unit and a reed unit. At the preparatory step, warp yarns of the full warp beam are drawn through the weaving components. At the mounting step, the full warp beam of the thus-prepared warp arrangement is mounted on the loom, and the weaving components holding the warp yarns are mounted on the loom.

However, these conventional looming methods require a further step of adjusting- a warp tension of the thus-mounted warp yarns to a value appropriate to the weaving operation. This additional step is troublesome and time-consuming.

SUMMARY OF THE INVENTION

It is an object of the invention to provide automatic looming systems and methods which can save time and trouble.

A looming system according to the present invention comprises a main weaving mechanism, a warp arrangement, carrier means, sensing means, and controlling means.

The main weaving mechanism comprises a warp let-off motion and a fabric take-up motion. The warp arrangement comprises a warp beam and a warp holding unit which comprises a weaving component through which warp yarns of the warp beam are drawn in, and a front warp gripper gripping the warp yarns. The carrier means is means for carrying the warp arrangement and mounting the warp arrangement on the main weaving mechanism. The carrier means comprises first arm means for carrying the warp beam, and second arm means for carrying the warp holding unit and moving the warp holding unit from a separate position to an engaged position at which the warp holding unit is engaged with the main weaving mechanism. The sensing means is means for sensing a force applied on the warp yarns by the second arm means while the second arm means is moving the warp holding unit from the separate position to the engaged position. The controlling means is means for causing the warp beam to rotate in accordance with the force sensed by the sensing means while the warp holding unit is moving from the separate position to the engaged position.

The warp holding unit may comprise a warp dropper unit, a heald unit and a reed unit.

A looming method according to the present invention comprises a first step of preparing the warp arrangement by drawing warp yarns of the warp beam through the warp holding unit and causing the warp yarns to be gripped by the warp holding unit, a second step of mounting the warp beam on a loom, a third step of sensing a warp tension of the warp yarns while moving the warp holding unit relative to the loom, and a fourth step of mounting the warp holding unit on the loom by moving the warp holding unit relative to the loom and rotating the warp beam so as to reduce a deviation of the warp tension from a predetermined standard.

It is another object of the present invention to provide a cassette apparatus which facilitates carriage and attachment of the weaving components.

A cassette apparatus according to the invention comprises a cassette frame for supporting at least one weaving component, a front warp gripper mounted on the cassette frame, first connecting means for facilitating carriage of the cassette frame, and second connecting means for fastening the cassette frame to a loom.

It is still another object of the present invention to provide a warp dropper mounting arrangement which makes it possible to easily attach and detach a warp dropper unit to and from a loom.

A warp dropper mounting arrangement according to the present invention comprises an attachment fixed to the dropper unit, and a clamp unit attached to the loom. The attachment projects downwardly from the dropper unit, and has a lower portion. The clamp unit is arranged to latch and unlatch the lower portion of the attachment.

It is still another object of the present invention to provide a holding device which holds heald frames and a reed, and facilitates installation of the heald unit and reed on a loom.

A holding device according to the present invention comprises a shaft member, a plurality of separator plates mounted on the shaft member at regular intervals for separating the heald frames one another, two base plates mounted on the shaft member for clamping therebetween the heald frames and the separator plates, and a reed holding portion for holding the reed.

It is still another object of the present invention to provide a looming system which makes it easier and safer to transfer a warp beam from a warp beam carrier to a loom and vice versa.

A looming system designed to accomplish this object comprises a loom, a carrier for carrying a warp beam, and connecting means for connecting the carrier with the loom in such a manner that the connecting means can support and guide the warp beam when the warp beam is transferred between the carrier and the loom.

DETAILED DESCRIPTION OF THE INVENTION

A first embodiment of the present invention is shown in FIGS. 1–6.

Figure 1:
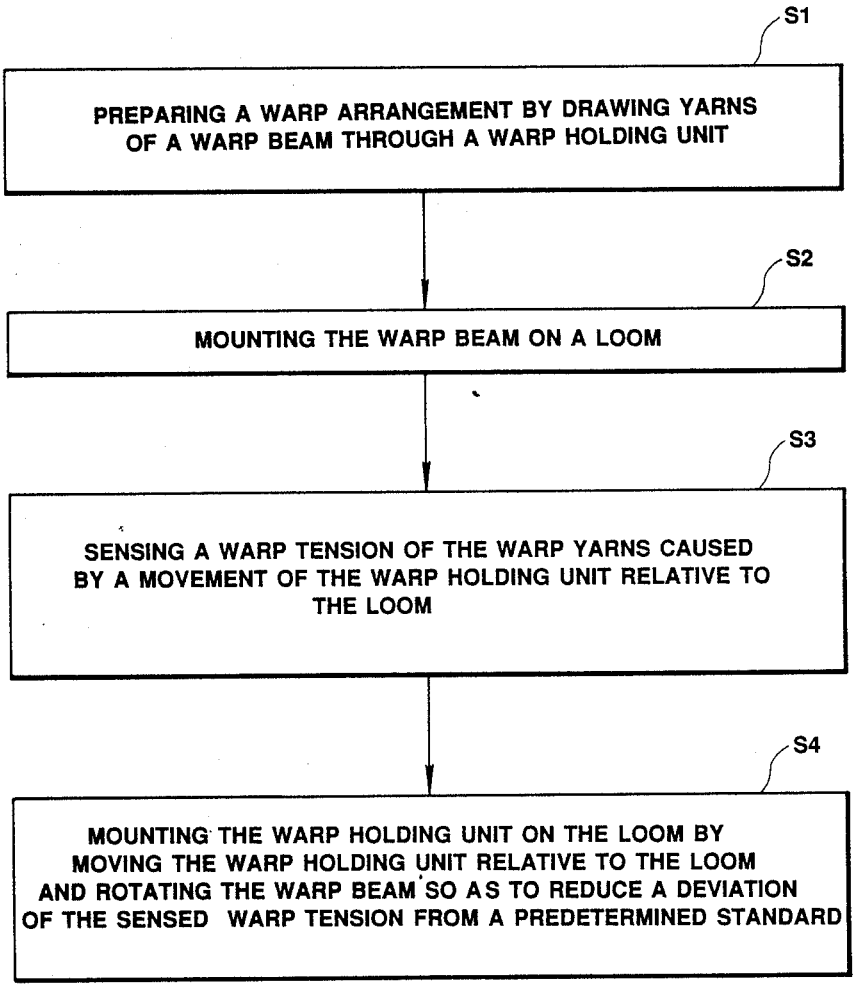
FIG. 1 is a flow chart showing a looming method according to a first embodiment of the present invention.

FIG. 1 shows basic steps of a looming method according to the first embodiment.

A first step S1 is a step of preparing a warp arrangement by drawing warp yarns of a warp beam through a warp holding unit which, in this embodiment, includes a warp dropper unit, a heald unit and a reed unit. A second step S2 is a step of mounting the warp beam on the loom. A third step is a step of sensing a warp tension of the warp yarns while moving the warp holding unit relative to the loom. In this embodiment, the warp tension is sensed by sensing a load applied on a back roller by the warp yarns. A fourth step S4 is a step of mounting the warp holding unit on the loom by moving the warp holding unit relative to the loom and rotating the warp beam already mounted on the loom so as to reduce a deviation of the sensed warp tension from a predetermined standard.

FIGS. 2–6 show a looming system according to the first embodiment of the invention.

In this embodiment, a warp dropper unit 1, a selvedge unit 2, a heald unit 3 and a reed unit 4 constitute a warp holding unit 5. The warp holding unit 5 and a full warp beam (or a yarn beam) 6 are carried by a carrier 7. The carrier 7 is a wheeled vehicle movable to a looming position at the rear of a loom. The looming operation is performed by holding the carrier 7 at the looming position.

Figure 2:
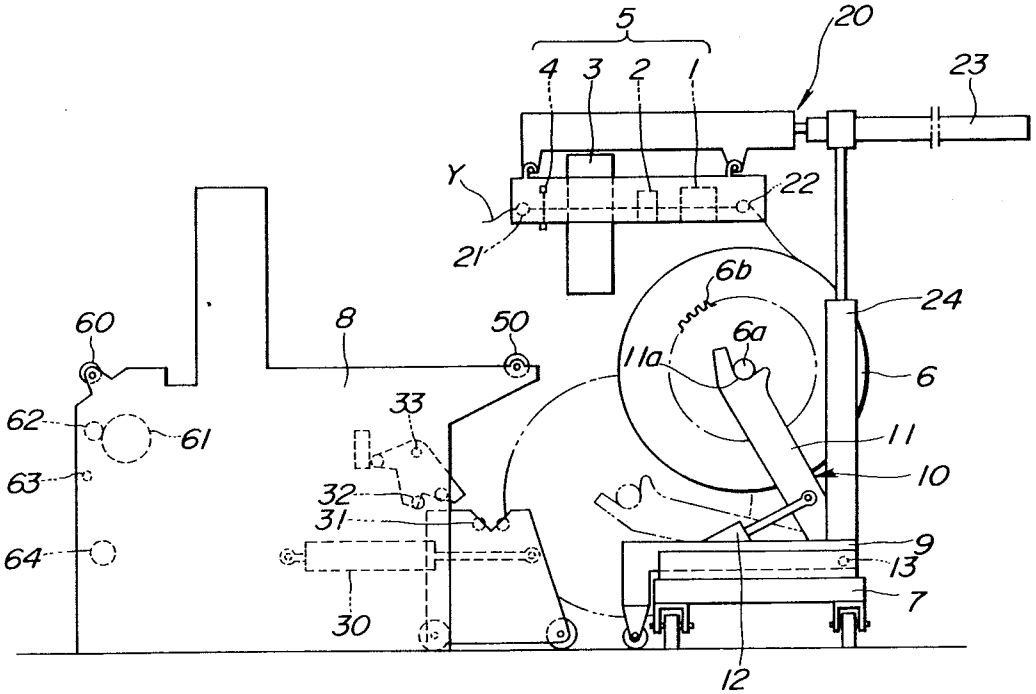
FIG. 2 is a side view showing a looming system of the first embodiment.
Figure 3:
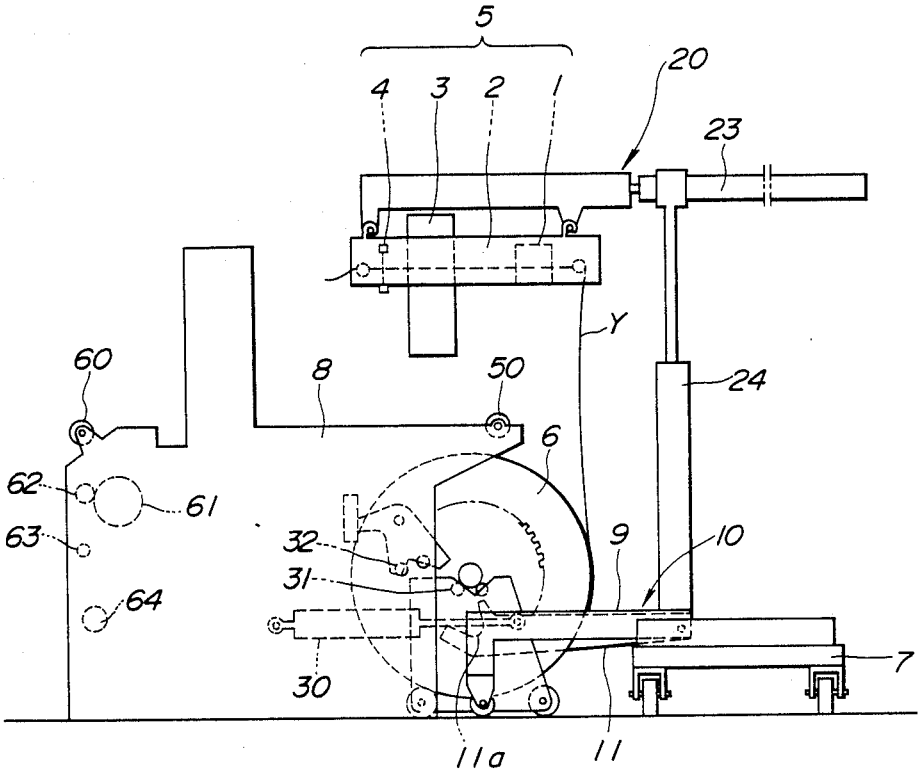
FIG. 3 is a side view of the looming system of the first embodiment for showing a step for mounting a warp beam on a loom.

The carrier 7 has a movable base member 9, which has wheels, and is movable between a retracted position shown in FIG. 2, and a projected position shown in FIG. 3. A beam supporting device 10 is supported on the base member 9. The beam supporting device 10 includes left and right swingable arms 11.

The carrier 7 shown in FIG. 2 carries a warp arrangement which was prepared in advance at a full warp beam station (not shown). The warp arrangement includes the full warp beam 6 and the warp holding unit 5. In the warp arrangement, warp yarns Y of the full warp beam 6 are drawn through the warp dropper unit 1, the selvedge unit 2, the heald unit 3 and the reed unit 4. The full warp beam 6 is mounted on the arms 11 of the beam supporting device 10, and the warp holding unit 5 is attached to a hanger device 20 which is supported on the base member 9 above the beam supporting device 10. The warp yarns Y drawn through the warp holding unit 5 are held in a tense state. In this embodiment, the warp holding unit 5 further includes front and rear warp yarn grippers 21 and 22. The dropper, selvedge, heald and reed units 1–4 are disposed between the front and rear grippers 21 and 22. The front gripper 21 grips forward ends of the warp yarns Y projecting forwardly from the reed unit 4. The rear gripper 22 grips the warp yarns Y at a position between the dropper unit 1 and the warp beam 6. With the grippers 21 and 22, the warp yarns Y between the dropper unit 1 and the reed unit 4 are held in the tense state. In this way, the warp arrangement is prepared and mounted on the carrier 7 at the full warp beam station.

On the other hand, a loom 8 requiring a looming operation is stopped, and an empty warp beam (not shown) is removed from the loom 8 in the following manner. Another carrier (not shown) is placed at the rear of the loom 8, and a lower bearing unit 31 supporting the empty warp beam is moved backwardly from a working position to a transferring position shown in FIG. 2 by extending a cylinder unit 30. During this backward movement of the lower bearing unit 31, the empty warp beam pushes rear rollers of an upper bearing unit 32, and causes the upper bearing unit 32 to swing backwardly about an axis 33 to an open position to allow the backward movement of the warp beam and the lower bearing unit 31.

Then, the empty warp beam is transferred from the lower bearing unit 31 to the waiting carrier. Warp receiving loom components such as the reed unit, heald unit and dropper unit are also removed from the resting loom 8 and mounted on the waiting carrier. Then, this carrier carrying the empty warp beam is moved to an empty beam station, and instead, the carrier 7 carrying the full warp beam 6 is moved to the looming position behind the loom 8, shown in FIG. 2.

At the looming position, the full warp beam 6 is lowered by swinging the supporting arms 11 from a supporting position shown by a solid line in FIG. 2 to a transferring position shown by a two dot chain line in FIG. 2. Then, the base member 9 is moved forward toward loom 8 from the retracted position toward the projected position until a shaft 6*a* of the full warp beam 6 reaches a position just above the lower bearing unit 31 remaining at its transferring position.

Then, the arms 11 are further swung downward about an axis 13 by contracting cylinders 12 until receiving portions 11*a* of the arms 11 are lowered below the lower bearing unit 31, as shown in FIG. 3. Therefore, both ends of the shaft 6*a* of the full warp beam 6 are placed on left and right members of the lower bearing unit 31.

Figure 4:
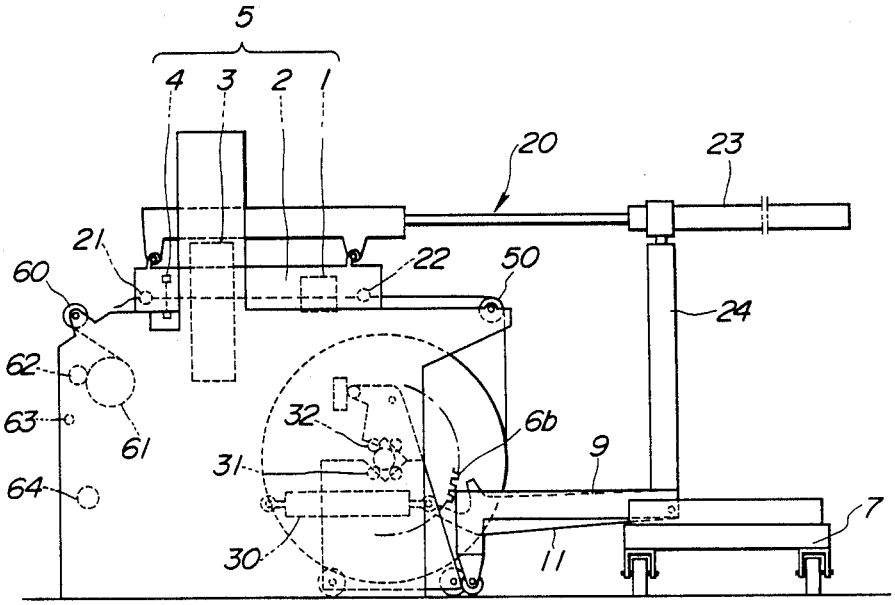
FIG. 4 is a side view of the looming system of the first embodiment for showing a step for mounting a warp dropper unit, a heald unit and a reed unit on the loom.

Then, the lower bearing unit 31 supporting the full warp beam 6 is moved forwardly from the transferring position shown in FIG. 3 to the working position. During the forward movement of the lower bearing unit 31, both ends of the shaft 6a of the full warp beam 6 pushes front rollers of the upper bearing unit 32, and accordingly the upper bearing unit 32 swings forwardly about the axis 33 to a closed position. In this position, both ends of the warp beam shaft 6a are supported between the lower and upper bearing units 31 and 32, as shown in FIG. 4, in such a firm manner as to ensure smooth and safe revolution of the shaft 6a. In this position, a driven gear 6b of the full warp beam 6 is engaged with a drive gear 41 of a warp let off motion 40 of the loom 8, as shown in FIG. 5.

Figure 5:
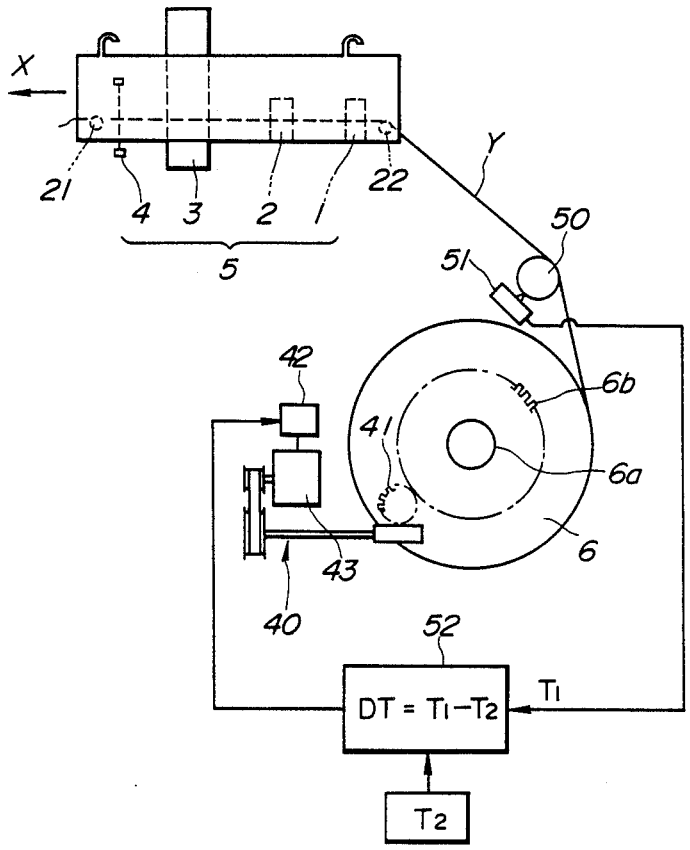
FIG. 5 is a schematic view showing a control system of the first embodiment.

After the full warp beam 6 has been mounted on the loom 8, the warp holding unit 5 gripping the warp yarns Y of the beam 6 is moved in the forward direction, shown by an arrow X in FIG. 5, from the rear of the loom 8 toward the front by extending a horizontal cylinder unit 23 of the hanger device 20 and contracting a vertical cylinder unit 24 of the hanger device 20. During this movement, the warp yarns Y stretched between the full warp beam 6 and the rear gripper 22 abut on a back roller 50 of the loom 8 and apply a forward pushing force on the back roller 50. A warp tension sensor 51 is provided between the back roller 50 and a side frame of the loom 8. The tension sensor 51 senses a warp tension $T_1$ of the warp yarns Y by sensing this pushing force produced by the forward movement of the warp holding unit 5, and delivers an electric signal proportional to the pushing force, to a controlling unit 52.

The controlling unit 52 receives the signal representing the sensed warp tension $T_1$, from the warp tension sensor 51, and compares the sensed warp tension $T_1$ with a reference warp tension $T_2$ which is preliminarly determined as a desired value suitable for the weaving operation. The controlling unit 52 produces a control signal Q in accordance with a deviation DT of the sensed tension $T_1$ from the reference tension $T_2$, and controls the warp let off motion 40 by sending the control signal to a drive circuit 42 of the warp let off motion 40. In response to the control signal of the controlling unit 52, the drive circuit 42 controls a motor 43 which is drivingly connected with the drive gear 41. Thus, the controlling unit 52 controls the rotational angle of the full warp beam 6 by rotating the warp beam forward and backward so as to reduce the deviation of the sensed warp tension $T_1$ from the reference warp tension $T_2$. While the rotation of the full warp beam 6 is being controlled by the controlling unit 52, the warp holding unit 5 is moved from the rear of the loom 8 toward the front by the horizontal and vertical cylinders 23 and 24 of the hanger device 20 until the warp holding unit 5 reaches a predetermined position of the loom 8. At this position, the reed unit 4, the heald unit 3, the selvedge unit 2 and the dropper unit 1 are located at respective proper positions of the loom 8. When this position is reached, the cylinders 23 and 24 are stopped, and each of the reed units 4, the heald unit 3 and the selvedge unit 2 is engaged with the loom 8, and connected with a corresponding drive mechanism. At the same time, the warp dropper unit 1. is engaged with the loom 8 and connected to an, electric feeder portion for thread breakage detection. The forward ends of the warp yarns Y projecting fowardly from the front gripper 21 are passed by hand through a breast roller 60, a friction roller 61, a press roller 62 and a guide roller 63, and wound on a cloth roller 64. Alternatively, the forward ends of the warp yarns Y are tied with rearward ends of a woven fabric extending from the cloth roller 64 through the guide roller 63, the press roller 62, the friction roller 61, and projecting rearwardly from the breast roller 60 toward the reed unit 4. Then, the front and rear grippers 21 and 22 are disengaged to release the warp yarns Y. In this way, the warp yarns Y are mounted on the loom 8.

Figure 6:
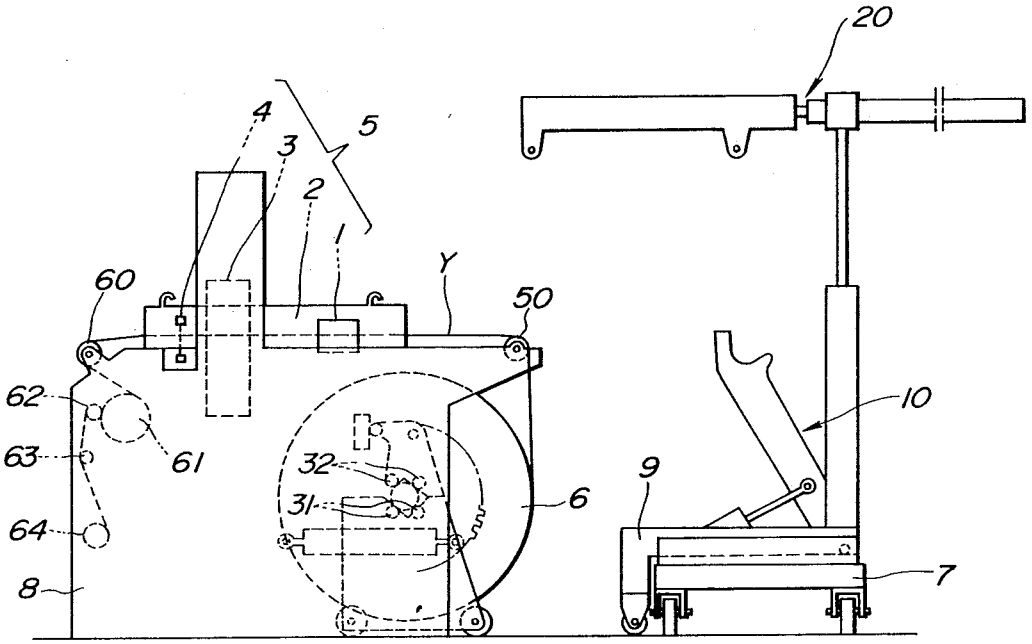
FIG. 6 is a side view of the looming system of the first embodiment in a state after the warp yarns are mounted on the loom.

The base member 9 is retracted to the retracted position, and the supporting arms 11 are swung upwardly to the supporting position, as shown in FIG. 6. Thus, the looming operation is completed by returning the carrier 7 to the empty warp beam station.

In this way, the looming system and method of the first embodiment can make the looming operation easier and less time-consuming by enablying us to mount warp yarns on looms at a desired tense state ready for immediate weaving operation.

The warp holding unit 5 of the first embodiment is shown more in detail in FIGS. 7–10. In this embodiment, the weaving components are united in the form of a cassette.

Figure 7:
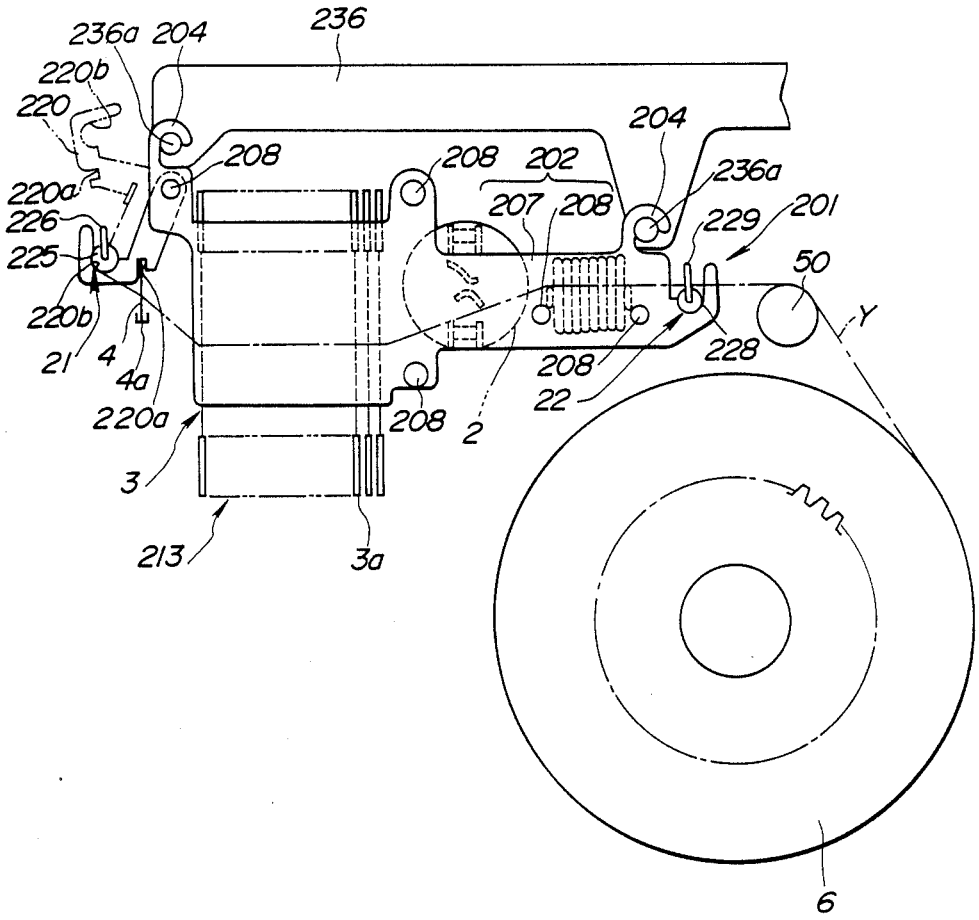
FIG. 7 is a side view of a cassette unit used in the first embodiment.
Figure 8:
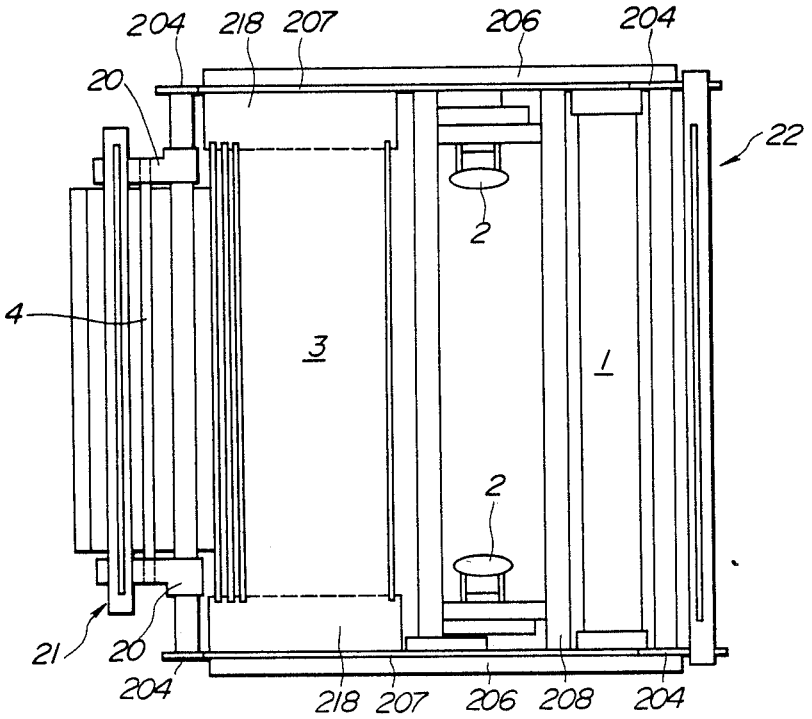
FIG. 8 is a plan view of the cassette unit of FIG. 7.

As shown in FIGS. 7 and 8, a cassette unit 201 includes a cassette frame 202 having a first portion 204 and a second portion 206. The cassette frame 202 is composed of left and right side members 207, and a plurality of leteral members 8 connecting the left and right side members 207. The side members 207 support the warp dropper unit 1, the selvedge unit 2, the heald unit 3, the reed unit 4, and the front and rear warp grippers 21 and 22. The dropper, selvedge, heald and reed units are all weaving components 213 used for weaving fabrics.

The warp dropper unit 1 has a plurality of movable electrodes each having a yarn hole through which one of warp yarns passes, and several fixed electrode assemblies each of which consists of an inner fixed electrode and an outer fixed electrode. The movable electrodes and fixed electrodes of the first embodiment are substantially indentical to those employed in a second embodiment of the invention shown in FIG. 11.

The heald unit 3 has a plurality of healds each having a mail through which one of warp yarns is passed, and a plurality of heald frames 3a supporting the healds. In weaving fabrics, the heald frames 3a are moved by a warp shedding mechanism of a tappet, crank, dobby or some other type. In the first embodiment, the heald frames 3a are supported on left and right heald guide members 218 which are fixed to the left and right cassette side members 207, respectively. The heald guide members 218 support the heald frames 3a so that, during weaving operation, the heald frames 3a can move up and down smoothly without shaking back and forth.

The selvedge unit 2 has left and right devices attached, respectively, to the left and right cassette side members 207 between the dropper unit 1 and the heald unit 3.

The reed unit 4 has a reed which is moved back and forth by a beating motion of the loom during weaving operation. Left and right swingable arms 220 are swingably mounted on the foremost lateral member 208 connecting the front ends of the left and right side members 207. Each arm 220 extends from the foremost lateral member 208 to a swingable end portion having a reed receiving portion 220a, and a gripper receiving portion 220*b*. Each arm 220 is swingable between a lower position shown by a solid line in FIG. 7 and an upper position shown by a two dot chain line in FIG. 7. The swingable arms 220 are mounted on the foremost lateral member 208 so that the position of each arm 220 can be adjusted along an axial direction of the foremost lateral member 208 (which is the same as the lateral direction of the loom and the weft inserting direction). At the lower position, the gripper receiving portion 220*b* in each arm 220 is ahead of the reed receiving portion 220*a*. The reed receiving portion 220*a* of each arm 220 is a depression formed in a surface which faces downwardly when the arm 220 is at the lower position. An upper end of a reed frame 4*a* is detachably attached to the reed receiving portions 220*a* of the left and right arms 220.

The warp yarns Y of the full warp beam 6 are drawn through the dropper unit 1, the selvedge unit 2, the heald unit 3 and the reed unit 4.

Figure 10:
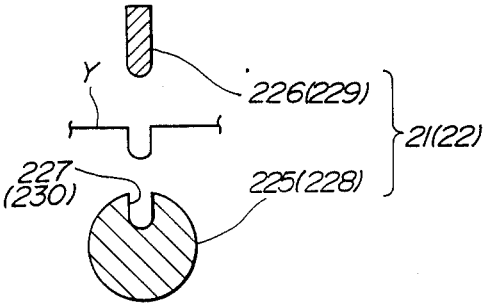
FIG. 10 is a sectional view showing each of front and rear warp grippers of the first embodiment in a separated state.

The front gripper 21 is a device for gripping and releasing forward ends of the warp yarns Y passing through the weaving components 213 and projecting forwardly from the reed unit 4. The front gripper 21 includes a gripper bar 225 and a stopper 226. The gripper bar 225 is detachably mounted in the gripper receiving portions 220*b* of the swingable arms 220. The gripper receiving portion 220*b* is a depression formed in a surface which faces upwardly when the arm 220 is at the lower position shown by a solid line in FIG. 7. The cross section of each gripper receiving portion 220*b* is shaped like an arc of a circle, opening upwardly. At the lower position, the gripper receiving portion 220*b* of each arm 220 is located forward of the reed receiving portion 220*a*. The gripper bar 225 has a groove 227 formed therein. The groove 227 extends along the axis of the gripper bar 225, and opens upwardly. The warp yarns Y are released when the stopper 226 is disengaged from the groove 227, as shown in FIG. 10. The warp yarns Y are gripped by placing the warp yarns Y between the gripper bar 225 and the stopper 226, and inserting the stopper 226 into the groove 227.

The rear gripper 22 is a device for gripping the warp yarns at a position between the dropper unit 1 and the warp beam 6. Like the front gripper 21, the rear gripper 22 includes a gripper bar 228 having a groove 230, and a stopper 229, as shown in FIG. 10. The rear gripper 22 is supported on the rear ends of the left and right cassette side members 207, and located rearwardly of the dropper unit 1.

The first portion 204 is a portion of the cassette frame 202 by which the cassette frame 202 can be connected with the carrier. The first portion 204 of this embodiment consists of left and right front hooks, and left and right rear hooks, as shown in FIG. 7. The left and right front hooks 204 project upwardly from the front ends of the left and right side members 207, respectively. The left and right rear hooks 204 project upwardly from the rear ends of the left and right side members 207, respectively. The hanger device 20 of the carrier 7 has a hanger arm 236 as shown in FIG. 7. The hanger arm 236 has front and rear supporting members 236*a*. The cassette can be suspended from the hanger arm 236 by engaging the front and rear hooks 204 of the cassette with the supporting members 236*a* of the hanger arm 236 in such a manner that the hooks 204 can be easily detached from the hanger arm 236, as shown in FIG. 7.

Figure 9:
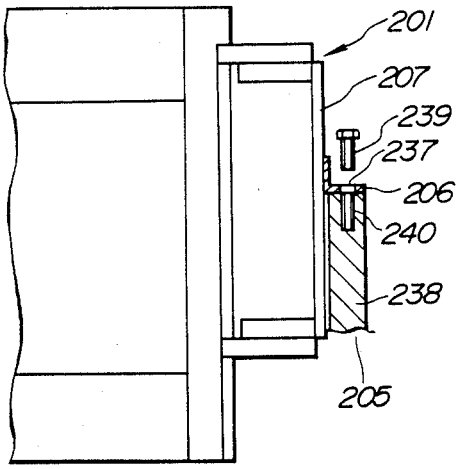
FIG. 9 is an elevational view showing an arrangement for fastening the cassette unit of FIG. 7 to a side frame of the loom.

The second portion 206 of the cassette frame 202 is a portion by which the cassette frame 202 can be fastened to a loom side frame 205, as shown in FIG. 9. The second portion 206 of this embodiment consists of left and right flanges 206 projecting outwardly from the left and right cassette side members 207, respectively. In each side member 207, the flange 206 extends substantially horizontal from the front end of the side member 207 to the rear end. Each flange 206 has one or more bolt holes 237. The cassette frame 202 can be mounted on the loom by placing the left and right flanges 206, respectively, on left and right mounting portions 238 of the loom side frames 205, and fastened to the loom side frames 205 by bolts 239. In the fastened state, each bolt 239 is passed vertically through one of the bolt holes 237 of the flanges 206, and tightened into one of threaded holes 240 formed in the mounting portions 238. Thus, the flanges 206 are detachably fastened to the mounting portions 238 of the loom side frames 205 by nonpermanent fastening means.

In this embodiment, the warp holding unit 5 is in the form of the casstte, so that the looming operation is very easy. The cassette unit 201 is mounted on the loom 8 as follows: The cassette unit 201 suspended from the hanger arm 236 is moved by the horizontal and vertical cylinders 23 and 24. When the cassette unit 201 arrives at the mounting portions 238 of the loom side frames 205, the cylinders 23 and 24 are stopped, and the hooks 204 are disengaged from the supporting members 236 of the hanger device 20. Then, the flanges 206 of the cassette unit 201 is placed correctly on the mounting portions 238 so that the bolts holes 237 coincide with the respective threaded holes 40. Then, the cassette unit 201 is fastened with the loom 8 by the vertically extending bolts 239. At the same time, the heald unit 3 and the reed unit 4 are connected with the respective drive mechanisms, and the warp dropper unit 1 is connected with the feeder circuit. Then, the reed frame 4*a* is disengaged from the swingable arms 220, and the forward ends of the warp yarns Y extending forward from the front gripper 21 are connected to the cloth roller 64 through the breast roller 60, the friction roller 61, the press roller 62 and the guide roller 63, or connected with the rearward ends of a remaining fabric. Then, the warp yarns Y are released by disengaging the stopper members 226 and 229 of the front and rear grippers 21 and 22 from the gripper bars 225 and 226. The left and right arms 220 are swung upwardly, and made immovable at the upper position. The cassette unit 201 of this embodiment can make it easier to position the dropper, selvedge, heald and reed units in the loom.

In this embodiment, it is possible to omit the rear gripper 22. Furthermore, it is possible to use, as the selvedge unit 2, a tuck-in selvedge apparatus, or a binder type apparatus.

It is possible to perform the looming method shown in FIG. 1 without employing the cassette frame 202.

Figure 11:
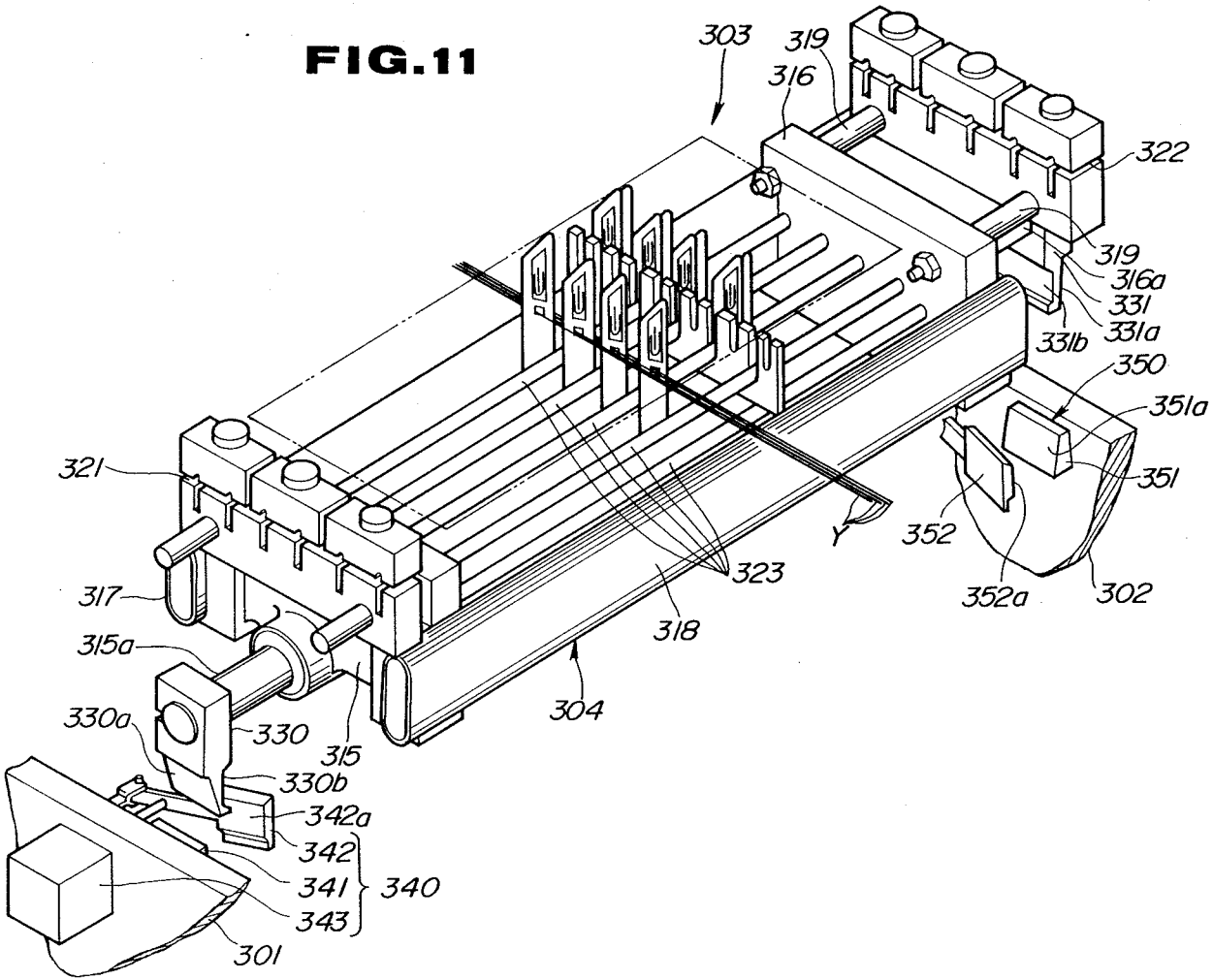
FIG. 11 is an exploded perspective view showing a warp dropper unit used in a second embodiment of the present invention.
Figure 12:
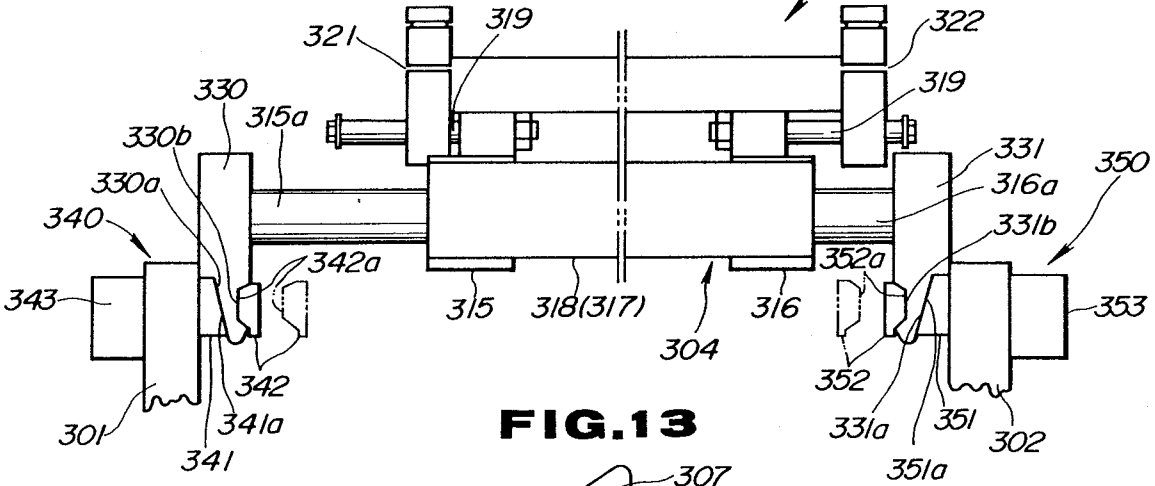
FIG. 12 is an elevational view showing the dropper unit of FIG. 11, installed in a loom.
Figure 13:
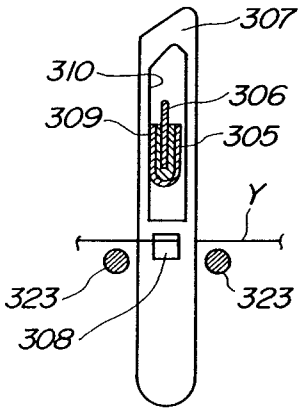
FIG. 13 is a sectional view showing a movable electrode and a fixed electrode assembly of the warp dropper unit of FIG. 11.

A second embodiment of the present invention is shown in FIGS. 11, 12 and 13. In a looming system of the second embodiment, the cassette unit is not employed, but the warp dropper unit is formed with left and right attachment portions which facilitate the attachment of the warp dropper to the loom.

As shown in FIG. 11, a loom has upright side frames 301 and 302 which are spaced at a predetermined distance in the lateral direction of the loom.

A warp dropper unit 303 of this embodiment includes a dropper frame 304, a plurality of fixed electrode members each of which consists of an inner electrode 306 and an outer electrode 305, and a plurality of movable electrodes 307.

As shown in FIG. 13, each movable electrode 307 has a yarn hole 308, and an elongated hole 310. Each of the warp yarns Y is inserted through the yarn hole 308 of a unique one of the movable electrodes 307. Each of the fixed electrode members is in the form of a bar, and extends in the lateral direction of the loom. In this embodiment, the movable electrodes 307 are arranged in several rows. Each of the fixed electrode members is assigned to a unique one of the rows of the movable electrodes 307. In each row, the fixed electrode member passes through the elongated holes of all the movable electrodes 307 of that row. In each fixed electrode member, the inner and outer electrodes 306 and 305 are separated by an insulating member 309. When the warp yarn is in the normal tense state as shown in FIG. 13, the movable electrode 307 is floating. When the warp yarn Y is broken, the movable electrode 307 falls by its own weight, and establishes an electrical connection between the inner and outer electrodes 306 and 305. In this way, the warp dropper unit can detect a breakage of any one of the warp yarns Y.

The dropper frame 304 includes side members 315 and 316, a front warp guide member 317 and a rear warp guide member 318. The side members 315 and 316 are spaced in the lateral direction of the loom. Each side member 315 or 316 has front and rear ends, and extends from the front end to the rear end along the fore and aft direction of the loom. The front warp guide member 317 are fixed to the front ends of the side members 315 and 316, and the rear warp guide member 318 is fixed to the rear ends of the side members 315 and 316, so that a rectangular frame is formed.

The dropper frame 304 further includes left and right electrode holders 321 and 322, which are fixed to the outer sides of the side members 315 and 316 through insulating members 319 and 320. The fixed electrode members from one of the holders 321 and 322 to the other, and are supported on the holders 321 and 322.

The dropper frame 304 further includes a plurality of separating bars 323 which extend between the side members 315 and 316 along the guide members 317 and 318 below the warp yarns. Both ends of each separating bar 323 are fixed to the side members 315 and 316 respectively. Each row of the movable electrodes 307 is separated from the next row by one of the separating bars 323. Each separating bar 323 limits the swing movements of the movable electrodes 307 of the neighboring row.

The warp dropper unit 303 further includes left and right attachments 330 and 331. The attachment 330 is fixed to the left side member 315 through a shaft portion 315*a*. The shaft portion 315*a* projects outward from a middle portion of the left side member 315 between the front and rear ends, substantially in parallel to the guide members 317 and 318. The left attachment 330 is fixed to the outer end of the shaft portion 315*a*, and extends downwardly from the outer end of the shaft portion 315*a*. The right attachment 331 is fixed to the right side member 316 through a shaft portion 316*a* in the same manner.

Each of the attachments 330 and 331 has a lower portion which has an inclined outer surface 330*a* or 331*a* and a recessed inner surface 330*a* or 331*a* and a recessed inner surface 330*b* or 331*b*. The outer surface 330*a* or 331*a* of each attachment 330 or 331 is inclined so that the lower portion of the attachment becomes thinner toward the lowermost end. The inner surface 330*b* or 331*b* of the lower portion of each attachment is formed with a recess.

The loom side frames 301 and 302 are provided with clamps 340 and 350, respectively.

The clamp 340 has a stationary member 341 fixed to an inner surface of the loom side frame 301, a movable member 342 swingably supported on the loom frame 301, and an actuator 343 attached to the side frame 301 for moving the movable member 342.

The stationary member 341 has an inclined inner guide surface 341*a*. The inner guide surface 341*a* is inclined so that the stationary member 341 becomes thicker toward the lowermost end. In an engaged state shown in FIG. 12, the guide surface 341*a* and the inclined outer surface 330*a* of the attachment 330 are parallel to each other, and tightly fit together.

The movable member 342 has a projected outer surface 342*a* which can be fit in the recessed inner surface 330*b* of the attachment 330. The movable member 342 is swingable about a vertical axis between a closed position shown by a solid line in FIG. 12, and an open position shown by a two dot chain line in FIG. 12.

The clamp 350 is arranged in a manner of bilateral symmetry with respect to the clamp 340. The clamp 350 includes a stationary member 351, a movable member 352 and an actuator 353. The stationary member 351 is shaped like a mirror image of the stationary member 341, and has an inclined inner guide surface 351*a* corresponding to the guide surface 341*a*. The stationary member 351 is fixed to the inner surface of the loom side frame 302. The movable member 352 has a projected outer surface 352*a* corresponding to the surface 342*a* of the movable member 352. The actuator 353 is connected with the movable member 352 so that the movable member 352 can be swung by the actuator 353.

The dropper unit 303 of the second embodiment is mounted on the loom in the following manner.

First, the clamps 340 and 350 are held open by the actuators 343 and 353. In this state, the movable members 342 and 352 are wider spaced from the respective stationary members 341 and 351, and located at the respective open positions shown by two dot chain lines in FIG. 12.

While the clamps 340 and 350 are held open, the dropper unit 303 is moved down from an upper position above the loom, until the attachments 330 and 331 reach an engaged position shown in FIG. 12. In this engaged position, the lower portion of each of the attachments 330 and 331 is placed in the clamp 340 or 350, between the stationary and movable members 341 and 342, or 351 and 352. During this downward movement of the dropper unit 303, the inclined guide surfaces 341*a* and 351*a* of the clamps 340 and 350 guide the inclined outer surfaces 341*a* and 351*a* of the attachments 330 and 331, and facilitate insertion of the attachments 330 and 331 into the right positions.

When the attachments 330 and 331 are put in the engaged position, the inclined outer surfaces 330*a* and 331*a* of the attachments 330 and 331 overlap the guide surfaces 341*a* and 351*a*, respectively, and the stationary members 341 and 351 engage with the lower portions of the attachments 330 and 331 so that the downward movement of the dropper unit 303 is limited.

Thereafter, the movable members 342 and 352 are swung to the respective closed positions shown by solid lines in FIG. 12, by the actuators 343 and 353. In this state, the projected outer surfaces 342*a* and 352*a* of the movable members 342 and 352 are fit in the respective recessed inner surfaces 330*b* and 331*b* of the attachments 330 and 331, and the attachments 330 and 331 are firmly clamped by the clamps 340 and 350. In this way, the dropper unit 303 can be easily attached to the loom.

The dropper unit 303 of the second embodiment can be easily removed from the loom by swinging the movable members 342 and 352 from the respective closed positions to the respective open positions shown by two dot chain lines in FIG. 12 by the actuators 343 and 353, and lifting up the dropper unit 303.

In this way, the attachments 330 and 331 and the clamps 340 and 350 of the second embodiment facilitate installation and removal of the warp dropper unit.

When the cassette unit 201 is employed as in the first embodiment, it is possible to provide the clamps 340 and 350 in the cassette frame 202 instead of the side frames of the loom.

A third embodiment of the present invention is shown in FIGS. 14–17. A looming system of the third embodiment employs holding devices 410 for holding heald frames and a reed.

Each of the holding device 410 of this embodiment includes a heald frame holding part 410A and a reed holding part 410B.

The heald frame holding part 410A of each holding device includes first and second base plates 411 and 412, a threaded rod 413 and a plurality of separator plates 415. The rod 413 is inserted through holes of the base plates 411 and 412. The first base plate 411 is loosely mounted on the rod 413, but the second base plate 412 is fixedly mounted on the rod 413. The second base plate 412 is secured to the rod 413 by a lock nut 414.

Figure 15:
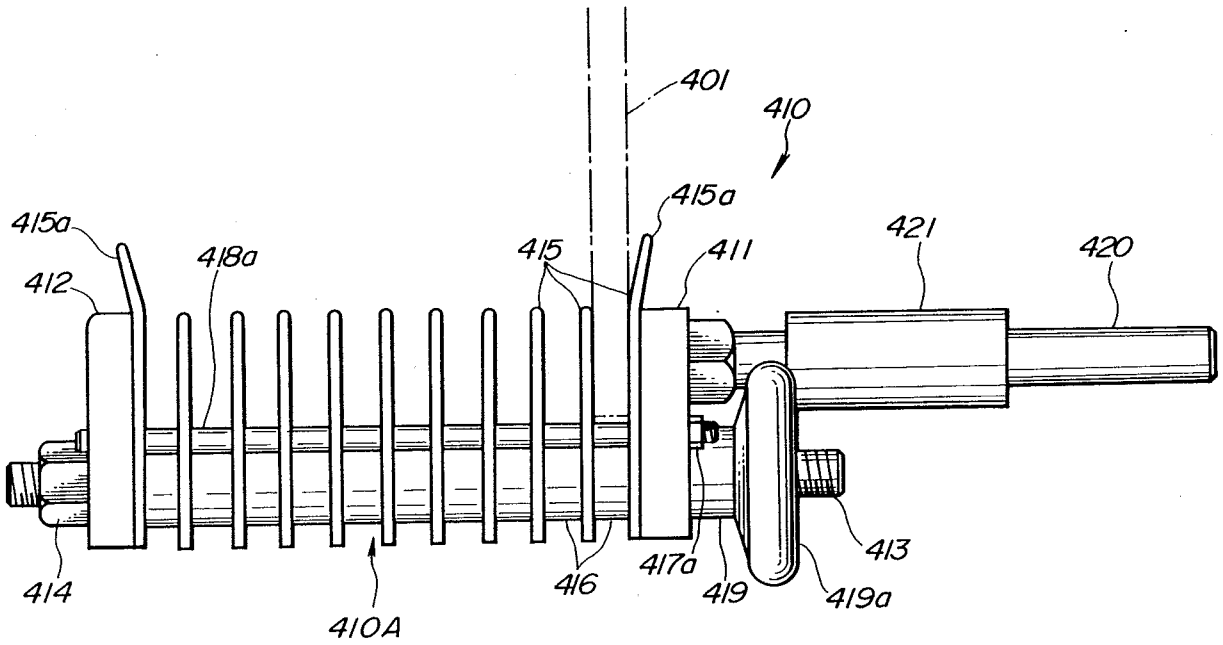
FIG. 15 is a plan view of the holding device of FIG. 14.
Figure 16:
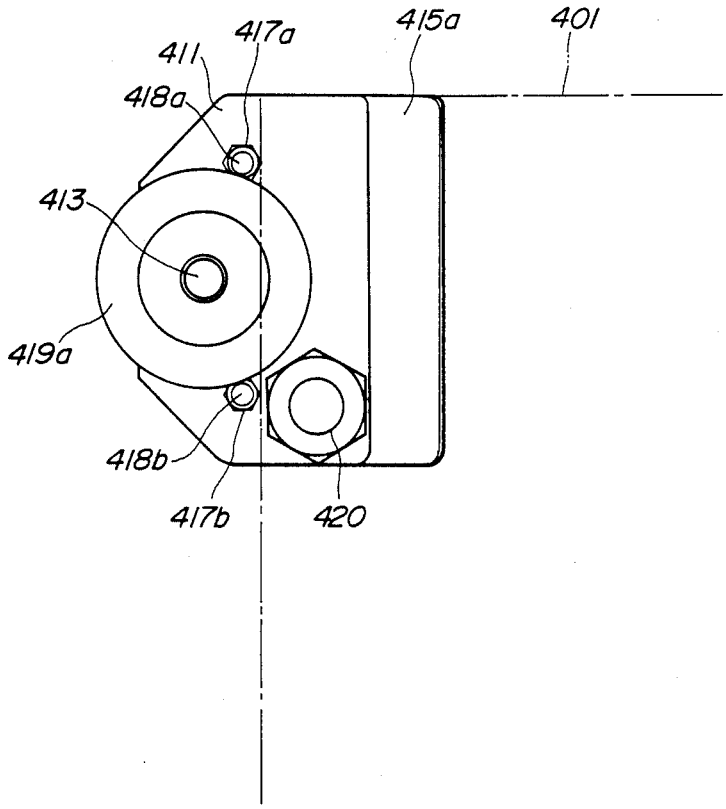
FIG. 16 is a side view of the holding device of FIG. 14.

The separator plates 415 are loosely mounted on the rod 413 between the first and second base plates 411 and 412. The separator plates 415 are spaced at regular intervals by annular spacers 416. Each of the two terminal separator plates 415 is formed with an inclined guide portion 415*a*, as shown in FIG. 15. The thickness of the separator plates 415 is made equal to a distance between the heald frames 401 installed in the loom. The thickness of the spacers 416 is made slightly smaller than the thickness of the heald frames 401.

The heald frame holding part 410A further includes two guide rods 418*a* and 418*b* which are fixed to the first base plate 411 by lock nuts 417*a* and 417*b*. The guide rods 418*a* and 418*b* are inserted through holes of the separator plates 415 and the second base plate 412 in order to prevent rotation of the separator plates 415.

The rod 413 has a threaded end portion projecting outwardly from the first base plate 411. A nut 419 having a handle 419*a* is screwed on the threaded end portion of the rod 413.

Figure 14:
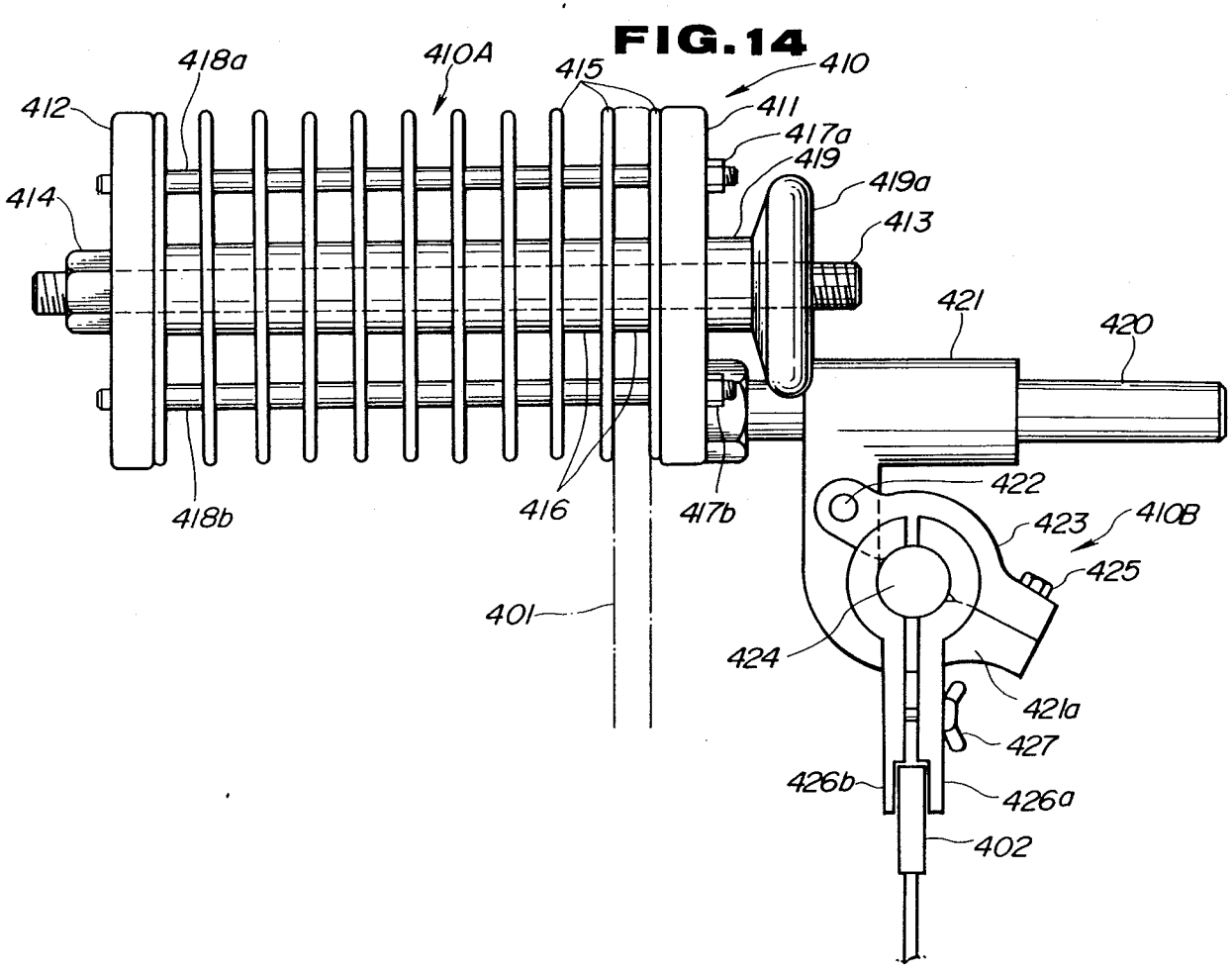
FIG. 14 is an elevational view of a holding device use in a third embodiment of the present invention

The reed holding part 410B of the holding device 410 includes a fixed rod 420 and a holder 421. The fixed rod 420 is fixed to the first base plate 411, and projects outwardly from the first base plate 411 in parallel to the threaded rod 413. The holder 420 is fixed to the fixed rod 420. The holder 420 has a receiving portion 421*a*, and a fixed pin 422. A lid member 423 is mounted on the holder 420 so that the lid member 423 can swing about the fixed pin 422. A support shaft 424 is clamped between the receiving portion 421*a* and the lid member 423, and secured by a bolt 425. A reed 402 is attached to the support shaft 424 by first and second finger pieces 426*a* and 426*b*. Each of the finger pieces 426*a* and 426*b* has an upper portion formed with a semicircular groove. The support rod 424 is received in the semicircular grooves of the first and second finger pieces, and firmly clamped between the finger pieces 426*a* and 426*b* by a bolt 427, as shown in FIG. 14. The reed 402 is clamped between lower portions of the finger pieces 426*a* and 426*b*.

Figure 17:
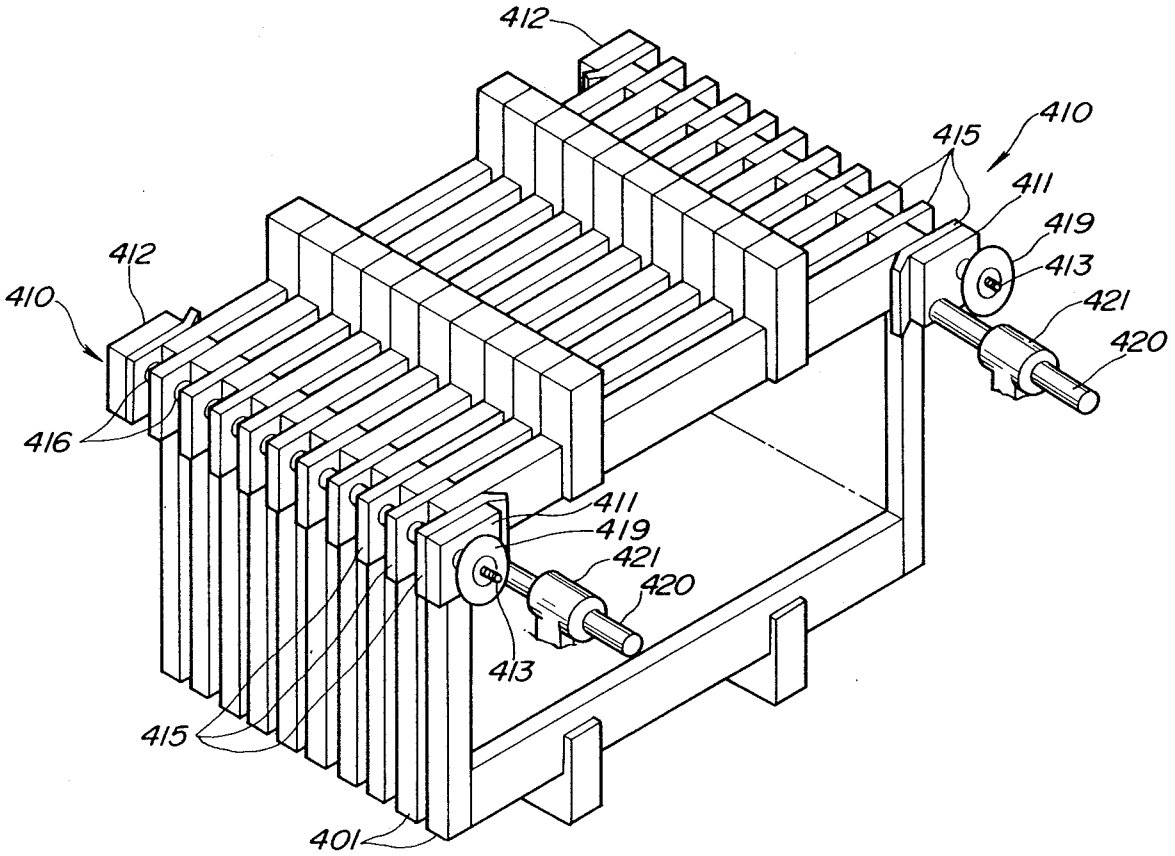
FIG. 17 is a perspective view showing a pair of the holding devices holding a plurality of heald frames.

The looming operation is performed by using the left and right holding devices 410 which are symmetrical with each other, as shown in FIG. 17. Each of the heald frames 401 is rectangular, and has left and right vertical members. One of the holding devices 410 holds the upper ends of the left side members of the heald frames, and the other of the holding devices 410 holds the upper ends of the right side members.

The heald frames 401 are attached to each holding device 410 in the following manner. First, the nut 419 is loosened to increase the spaces between the separator plates 415. Then, the upper end of the side member of each heald frame 401 is placed between the separator plates 415 so that the separator plates 415 and the heald frames 401 are arranged alternately. Then, the nut 419 is tightened on the threaded rod 413 to clamp the heald frames 401 among the separator plates 415.

The reed 402 is attached to each holding device 410 by loosening the bolt 427, placing an upper portion of the reed 402 between the finger pieces 426*a* and 426*b*, and tightening the bolt 427 to clamp the reed 40 between the finger pieces 426*a* and 426*b*.

The assembly of the heald frames 401, the reed 402 and the left and right holding devices 410 is brought to the loom, and installed in the loom so that the heald frames 401 and the reed 402 are properly positioned in the loom. Thereafter, the holding devices 410 are removed from the heald frames 401 and the reed 402. In this way, the holding devices 410 of the third embodiment facilitate the positioning of the heald frames and the reed in the looming operation.

The holding devices 410 of the third embodiment can be used also for removing the heald frames 401 and the reed 402 from the loom.

It is possible to add a third part for holding a warp dropper unit. In this case, each holding device includes the first part for holding the head frames, the second part for holding the reed, and the third part for holding the warp dropper unit.

A fourth embodiment of the present invention is shown in FIGS. 18–30. A looming system of the fourth embodiment is arranged to solve problems of a conventional looming system disclosed in Japanese Patent Provisional Publication No. 62-206066.

Figure 31:
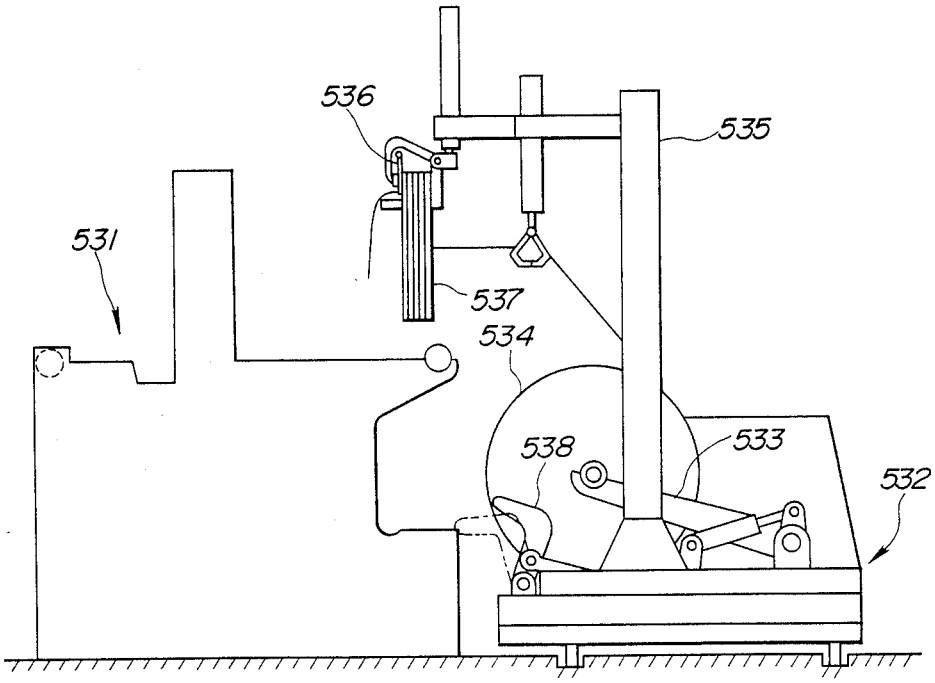
FIG. 31 (PRIOR ART)
FIG. 31 is a side view showing a conventional looming system.

As shown in FIG. 31, the conventional looming system employs a carrier 532 having supporting levers 533 for supporting a warp beam 534, and an upright column 535 for carrying a reed 536, and heald frames 537. The carrier 532 further includes swingable levers 538. The carrier 532 is connected with a loom 531 by the levers 538 in order to prevent the carrier 532 from being tilted by the weight of the warp beam 534.

However, the levers 538 cannot hold the carrier 532 firmly at the correct position relative to the loom 531, so that the carrier 532 is easily shifted out of the correct position during transfer of the warp beam 534. Furthermore, the carrier 532 has the supporting levers 533 and the swingable levers 538, so that the mechanism is complicated, and the looming operation is made troublesome.

Figure 18:
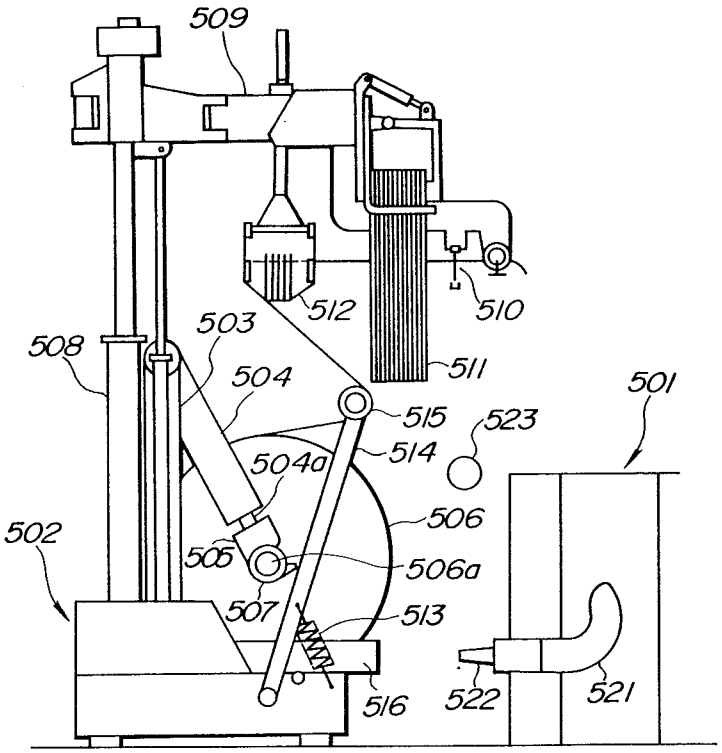
Figure 27:
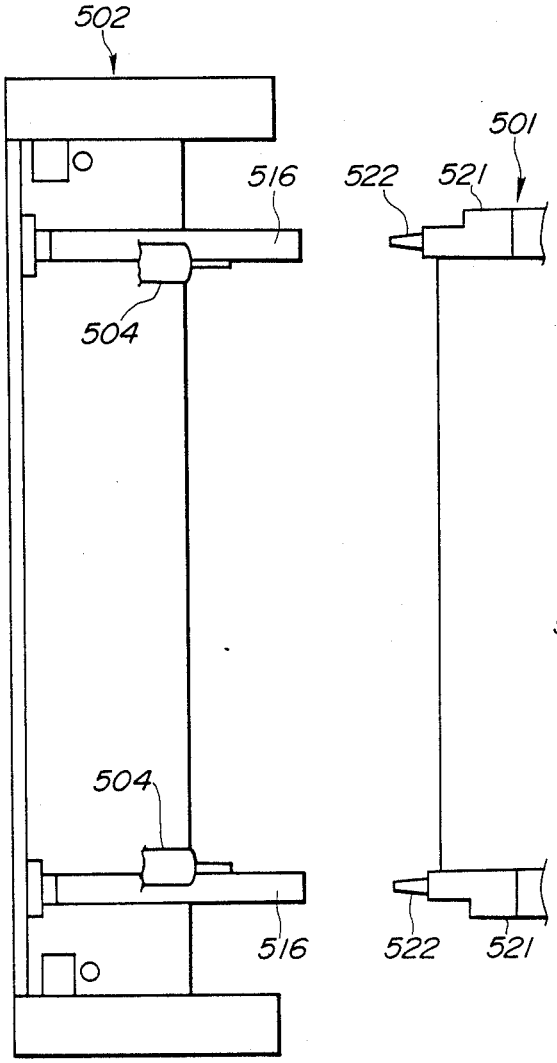
FIG. 27 is a schematic plan view of the looming system of the fourth embodiment.
Figure 29:
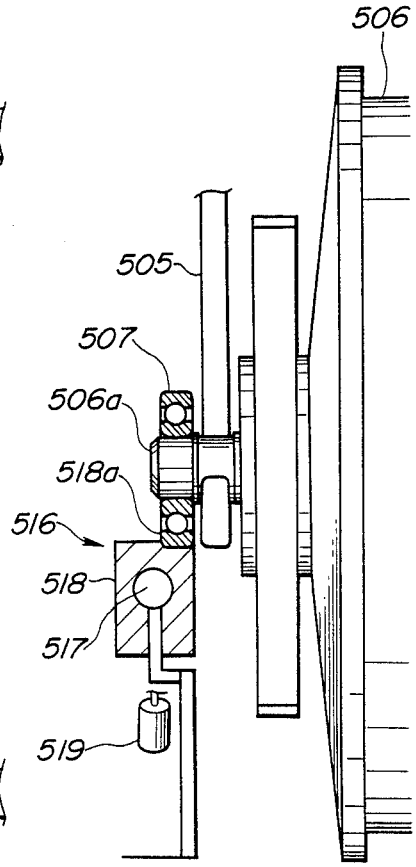
FIG. 29 is a view taken in a direction shown by an arrow A in FIG. 28.

FIG. 18 shows a loom 501 and a carrier 502 of the fourth embodiment. In FIG. 18, the carrier 502 is placed at a looming position behind the loom 501 near a back roller 523. FIG. 27 is a schematic plan view showing the loom 501 and the carrier 502 at the looming position.

The carrier 502 has a support device 503, and a hydraulic cylinder unit 504 consisting of left and right cylinder actuators. The support device 503 supports base ends of the cylinder actuators 504 so that the cylinder actuators 504 are swingable, and the base ends are movable vertically. Each cylinder actuator 504 has a piston rod 504*a* which has a beam supporting portion 505 at an end. A shaft 506*a* of a warp beam 506 is placed on the beam supporting portions 505 of the left and right cylinder actuators 504. Each of the left and right ends of the warp beam shaft 506*a* is provided with a ball bearing 507.

The carrier 502 further has an upright structure 508 having a movable bracket 509 carrying a reed 510, heald frames 511 and a warp dropper unit 512. Warp yarns of the warp beam 506 are drawn through the dropper unit 512, the heald frames 511 and the reed 511. A tension bar unit 514 is swingably supported on the carrier 502, and urged by at least one spring 513. The tension bar unit 514 has a roller 515 at an upper end. The warp yarns extend from the warp beam 506 to the dropper unit 512 by way of the roller 515.

The carrier 502 further has left and right connecting members 516 which combine a first function of connecting the carrier 502 to the loom 501 firmly, and a second function of guiding the warp beam 506. Each connecting member 516 extends in a fore and aft direction, and is extensible. The loom 501 of this embodiment is provided with left and right receiving members 521 for receiving the left and right connecting members 516, respectively.

Figure 28:
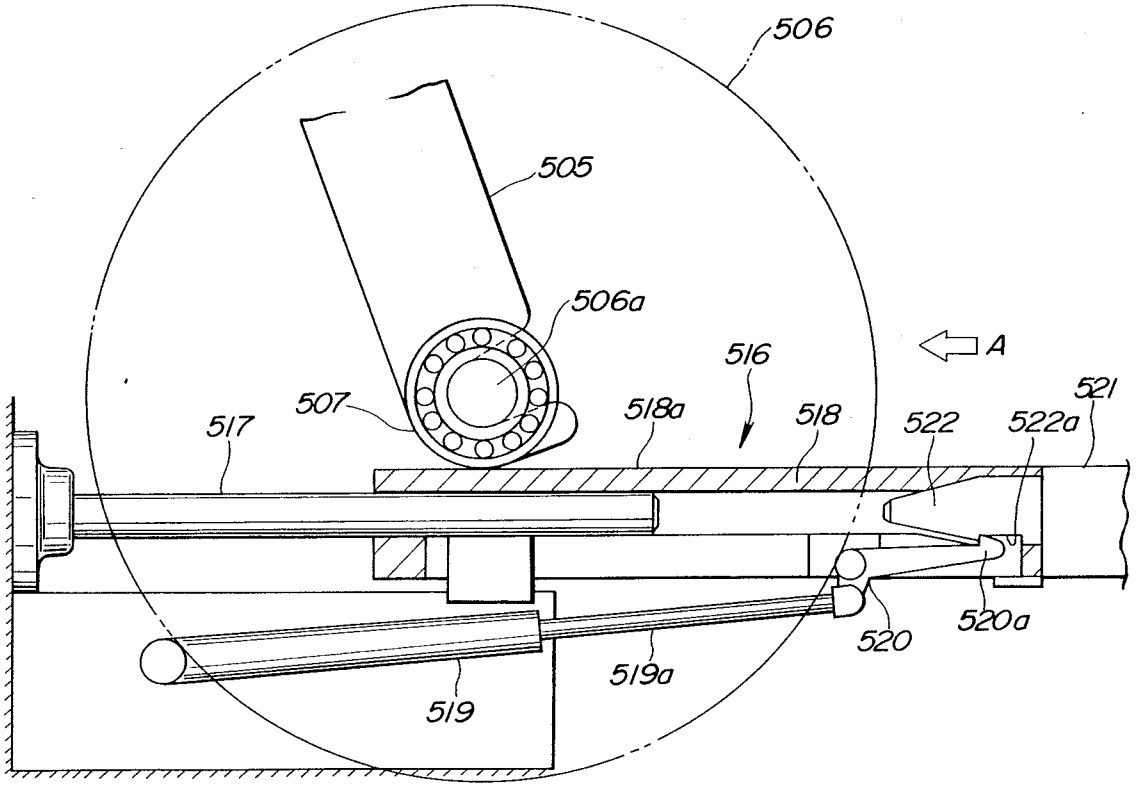
FIG. 28 is a side view showing a connecting member of the fourth embodiment.
Figure 30:
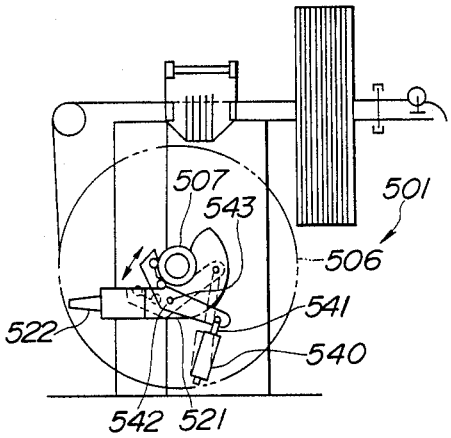
FIG. 30 is a side view showing a receiving member of the fourth embodiment.

FIGS. 28 and 30 show the connecting member 516 and the receiving member 521 on one side in a connected state. The connecting member 516 of each side has a fixed rod 517, and a connecting tube member 518 which is slidably mounted on the fixed rod 517. The tube 518 has an upper surface 518*a* which is so shaped as to serve as a guide rail. The tube 518 is connected with a piston rod 519*a* of a hydraulic cyliner actuator 519 through a swingable lever 520, so that the tube 518 can be moved axially along the fixed rod 517 by the hydraulic cylinder actuator 519. The receiving member 521 has a tapered end 522 projecting rearwardly. In the connected state shown in FIG. 28, the tapered end 522 is inserted into a front end of the tube 518. The lever 520 is in the form of a bell crank. The lever 520 has a first arm connected with the piston rod 519*a*, and a second arm having a hooked portion 520*a*. The fulcrum of the lever 520 is located at the apex of the angle formed by the first and second arms, and supported by the tube 518. The second arm projects forwardly from the fulcrum, and its hooked portion 520 is capable of engaging with a recessed portion 522*a* of the tapered portion 522 of the receiving member 521.

In the fourth embodiment, the looming operation is performed in the following manner.

At a first step, the warp arrangement including the full warp beam 506, the dropper unit 512, the heald frames 511 and the reed 510 is prepared and carried to the looming position shown in FIG. 18.

Figure 19:
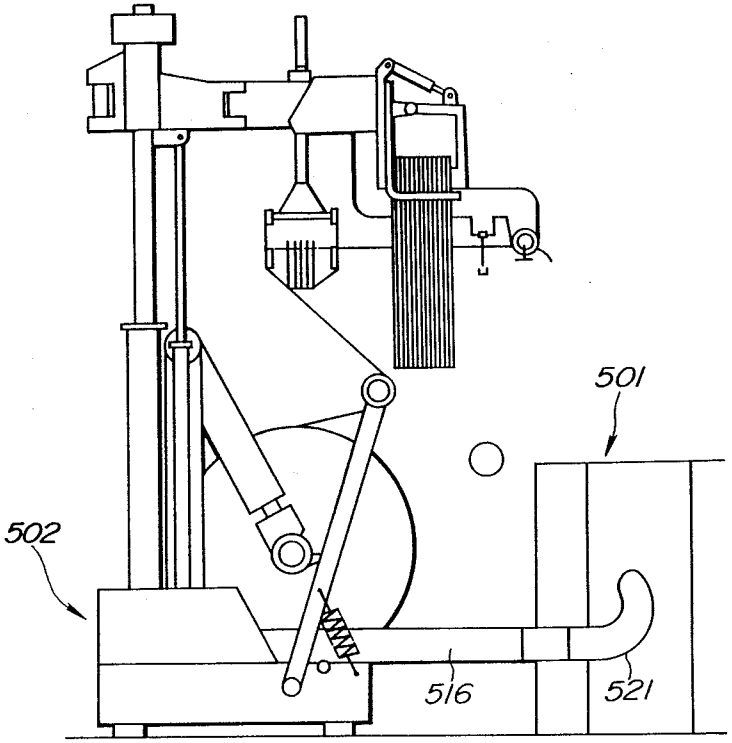
FIGS. 18–26 are side views of a looming system of a fourth embodiment of the present invention in various states during a looming operation.

At a second step, the carrier 502 is connected to the loom 501 as shown in FIG. 19.

As shown in FIG. 28, the tube 518 of the connecting member 516 of each side is pushed forwardly by the cylinder actuator 519 through the lever 520, and projected from the carrier 502 until the tube 518 fits over the tapered end 522 of the receiving member 521. During this, the tapered end 522 slightly pushes down the hooked portion 520 of the lever 520, and the hooked portion 520*a* is engaged with the recessed portion 522*a* of the receiving member 521. In this way, the connecting member 516 is locked by the lever 520.

Figure 20:
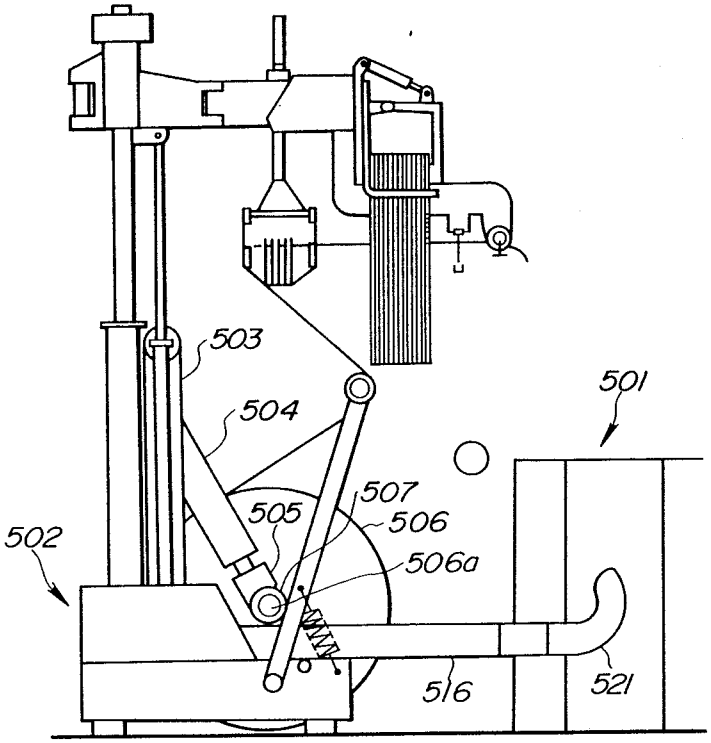

At a third step, the warp beam 506 is lowered to a position shown in FIG. 20 by lowering the base end of the cylinder unit 504 by the support device 503. In this position, the ball bearings 507 of the left and right ends of the warp beam shaft 506*a* rest on the guide rails 518*a* of the left and right connecting members 516.

Figure 21:
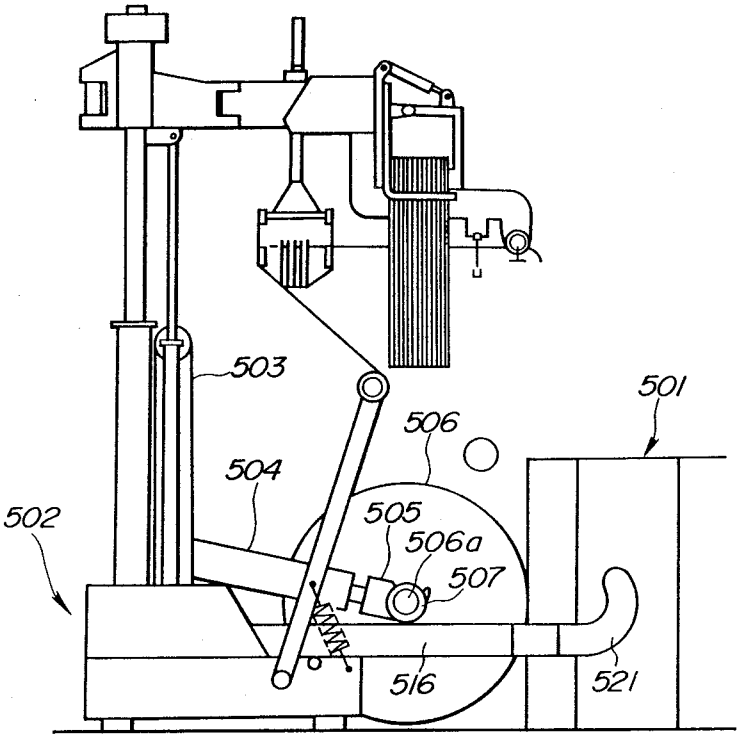
Figure 22:
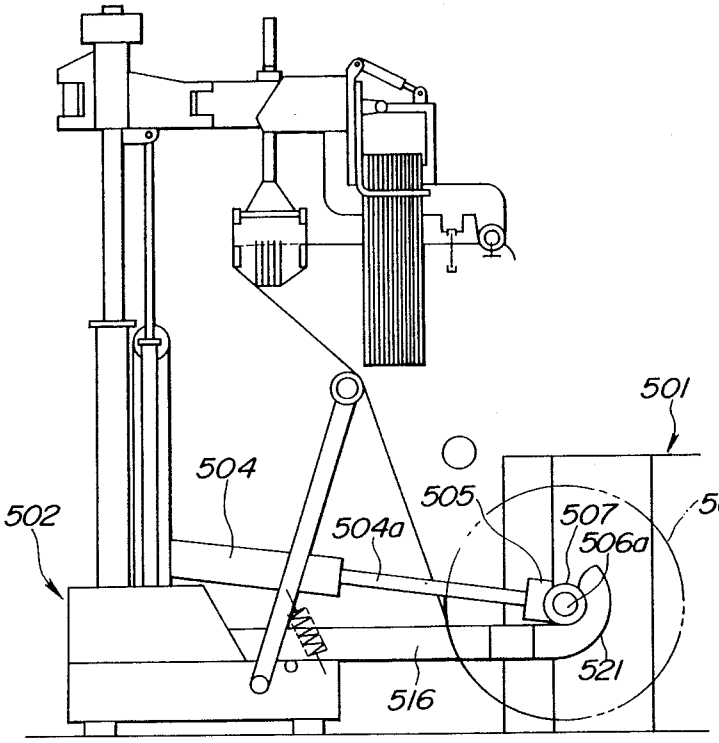

At a fourth step, the warp beam 506 is moved forward by further lowering the base ends of the left and right cylinder actuators 504, as shown in FIG. 21. During this movement, the guide rails 518 support and guide the ball bearings 507 of the warp beam shaft 506*a*, and outer races of the ball bearings 507 roll on the guide rails 518. Then, the warp beam 506 is further moved forward by projecting the rod 504*a* of the cylinder actuator 504 on each side until the warp beam shaft 506*a* is received in the receiving members 521 of the loom 501, as shown in FIG. 22. Then, the warp beam shaft 506*a* is removed from the warp beam supporting portions 505 of the cylinder rods 504*a* by slightly lifting up the ball bearings 507 with a swingable bracket 542 and a trunnion type cylinder actuator 540 provided on each side of the loom 501, as shown in FIG. 30. The bracket 542 is swingable about an axis 543, and the cylinder actuator 540 is connected with one arm of the bracket 542. The ball bearing 507 is lifted up by swinging the bracket 542 by the cylinder actuator 540 from a position shown by a broken line in FIG. 30 to a position shown by a solid line. In this position, the ball bearing 507 of each side is securely clamped between the bracket 542 and the receiving member 521, and the warp beam 506 is engaged with a warp let-off motion of the loom 501.

Figure 23:
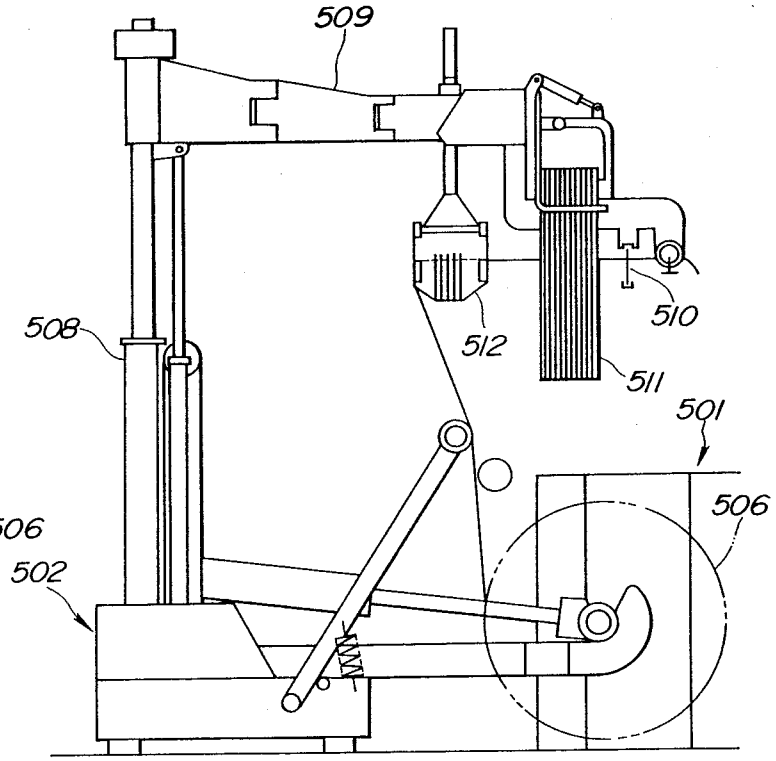
Figure 24:
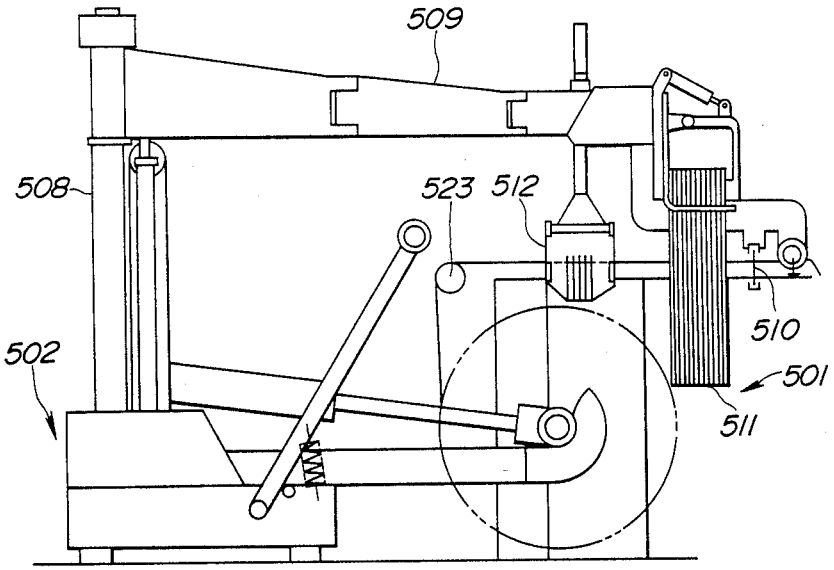

At a fifth step, the warp holding unit including the reed 510, the heald frames 511 and the warp dropper unit 512 is moved forward by the movable bracket 509, as shown in FIG. 23, and then the warp holding unit is lowered, as shown in FIG. 24. In the position shown in FIG. 24, the reed 510, the heald frames 511 and the warp dropper unit 512 are properly installed in the loom 501.

Figure 25:
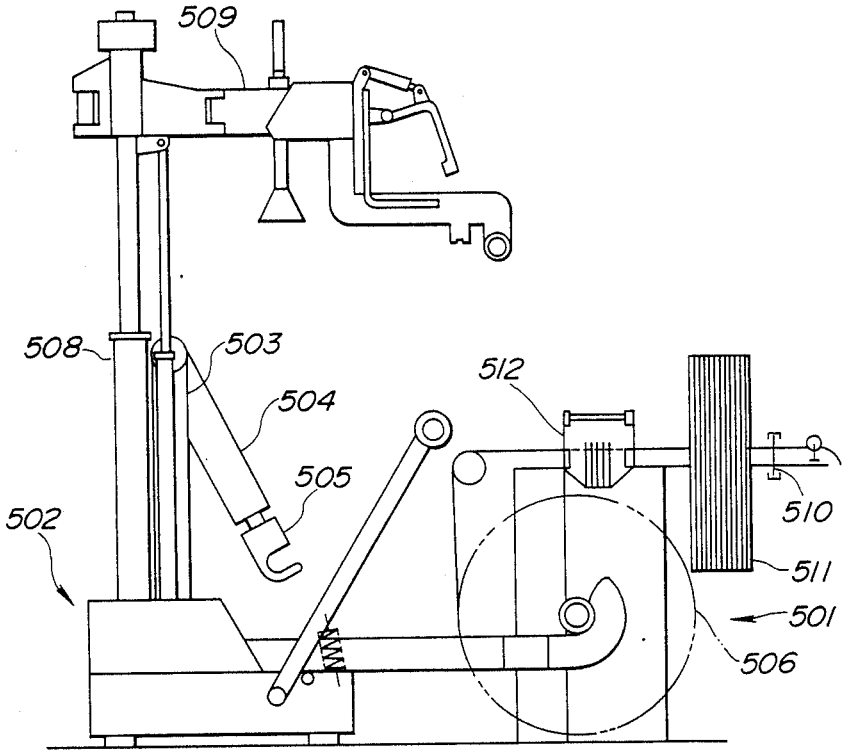
Figure 26:
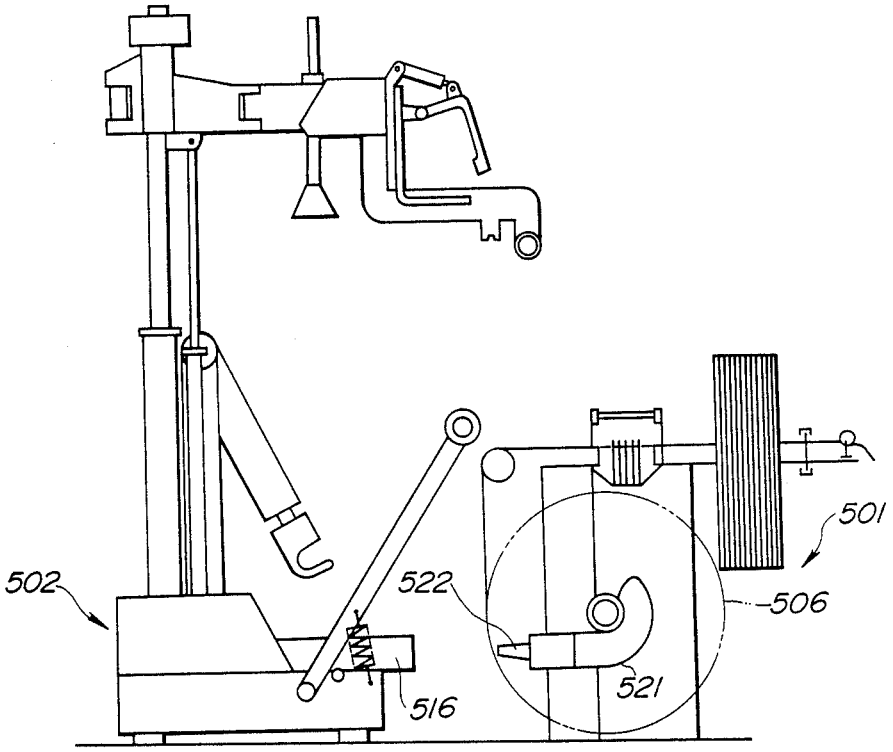

Thereafter, the cylinder actuators 504 and the movable brackets 509 are retracted, as shown in FIG. 25. Then, the connecting member 516 of each side is disconnected from the receiving member 521 by retracting the piston rod 519*a*. During this, the piston rod 519*a* pulls one arm of the lever 520 rearward, so that the lock lever 520 is swung in the clockwise direction in FIG. 28, and the hooked portion 520*a* is disengaged from the recessed portion 522*a*.

The looming system of this embodiment makes it easier to dismount the warp beam and the warp holding unit from the loom. In this case, the above-mentioned steps are performed in the reverse order.

In this embodiment, the extensible connecting members are provided in the carrier 502. However, it is possible to make the connecting members of the carrier fixed, and the receiving members of the loom extensible.

It is possible to replace lock lever 520 by a locking device of some other type such as a ball lock type.

In this embodiment, the carrier is connected with the loom securely and safely, and the warp beam is guided by the connecting members. Therefore, the looming system of this embodiment can make the looming operation easy and safe with a simple mechanism.

What is claimed is:

1. A looming system comprising;

a main weaving mechanism comprising a warp let off motion and a fabric take up motion, a warp arrangement comprising a warp beam and a warp holding unit which comprises a weaving component through which warp yarns of said warp beam are drawn in, and a front warp gripper gripping said warp yarns, carrier means for carrying said warp arrangement and mounting said warp arrangement on said main mechanism, said carrier means comprising first arm means for carrying said warp beam and second arm means for carrying said warp holding unit and moving said warp holding unit from a separate position to an engaged position at which said warp holding unit is engaged with said main weaving mechanism, sensing means for sensing a force applied on said warp yarns by said second arm means while said second arm means is moving said warp holding unit from said separate position to said engaged position, and controlling means for causing said warp beam to rotate in accordance with said force sensed by said sensing means while said warp holding unit is moving from said separate position to said engaged position.

2. A looming system according to claim 1 wherein said warp holding unit comprises a warp dropper unit, a heald unit and a reed unit.

3. A looming system according to claim 2 wherein said warp holding unit further comprises a rear warp gripper for gripping said warp yarns.

4. A looming system according to claim 2 wherein said sensing means comprises a detecting element provided between a back roller of said main weaving mechanism, and a stationary member of said main weaving mechanism.

5. A looming system according to claim 2 wherein said warp holding unit comprises a cassette frame on which said warp dropper unit, said heald unit, said reed unit and said front warp gripper are mounted, said cassette frame comprising first connecting means for connecting said cassette frame with said second arm means, and second connecting means for connecting said cassette frame with said main weaving mechanism.

6. A looming system according to claim 5 wherein said cassette frame comprises left and right side members and lateral members connecting said side members, said first connecting means comprises a plurality of hooked portions projecting upwardly from said side members, and said second connecting means comprises left and right flanges projecting outwardly from said left and right side members, respectively.

7. A looming system according to claim 2 wherein said dropper unit comprises a dropper frame, and left and right attachments which project downwardly from left and right sides of said dropper frame, respectively, and said main weaving mechanism comprises left and right clamps for latching and unlatching said attachments, respectively.

8. A looming system according to claim 7 wherein said left and right clamps are mounted on left and right side frames of said main weaving mechanism, each of said attachment comprises a lower portion having an inclined outer surface and a recessed inner surface, and each of said clamps comprises a stationary member which is fixed to one of said side frames of said main weaving mechanism, and has an inclined guide surface for guiding said inclined outer surface of said attachment, and a movable member which is movably mounted on one of said side frames of said main weaving mechanism, and has a projected surface for fitting in said recessed inner surface of said attachment.

9. A looming system according to claim 2 wherein said warp holding unit comprises a holding device for holding heald frames of said heald unit, and said reed unit, said holding device comprising separating plates for separating said heald frame from one another at regular intervals.

10. A looming system according to claim 1 wherein said carrier means comprises connecting means and said main weaving means comprises receiving means which can be connected with said connecting means, said connecting and receiving means being so arranged that when said connecting and receiving means are connected with each other, said connecting and receiving means can secure said carrier means at a predetermined position relative to said main weaving mechanism and guide said warp beam from said carrier means to said main weaving mechanism.

11. A looming system according to claim 10 wherein said connecting means comprises left and right extensible connecting members which extend substantially horizontal and which are positioned so as to support both ends of a shaft of said warp beam.

12. A looming method for mounting warp yarns on a loom, comprising a first step of preparing a warp arrangement by drawing warp yarns of a warp beam through a warp holding unit and causing said warp yarns to be gripped by said warp holding unit, a second step of mounting said warp beam on said loom, a third step of sensing a warp tension of said warp yarns while moving said warp holding unit relative to said loom, and a fourth step of mounting said warp holding unit on said loom by moving said warp holding unit relative to said loom and rotating said warp beam so as to reduce a deviation of said warp tension from a predetermined standard.

13. A looming method according to claim 12 wherein said first step comprises a step of preparing said warp holding unit which includes a cassette frame supporting a warp dropper unit, a heald unit and a reed unit through which said warp yarns are drawn in, and said fourth step is accomplished by carrying said warp holding unit by holding said cassette frame and fixing said cassette frame to said loom.

14. A looming method according to claim 12 wherein said first step comprises a step of carrying said warp arrangement to a predetermined position near said loom by a wheeled carrier, and said second step comprises a step of connecting said carrier with said loom by two parallel connecting members and transferring said warp beam from said carrier to said loom while supporting said warp beam by said connecting members.

* * * * *